343-754 SR
8/23/77 OR 4,044,361

United States Patent [19]

Yokoi et al.

[11] 4,044,361

[45] Aug. 23, 1977

[54] SATELLITE TRACKING CASSEGRAINIAN ANTENNA

[75] Inventors: Hiroshi Yokoi, Machida; Masataka Akagawa, Yokohama, both of Japan

[73] Assignee: Kokusai Denshin Denwa Kabushiki Kaisha, Japan

[21] Appl. No.: 681,450

[22] Filed: Apr. 29, 1976

[30] Foreign Application Priority Data

May 8, 1975 Japan ..... 50-54240

[51] Int. Cl.[2] ..... H01Q 19/18; H01Q 3/12

[52] U.S. Cl. ..... 343/754; 343/761; 343/781 CA; 343/837

[58] Field of Search ..... 343/754, 761, 781 P, 343/781 CA, 837, 839

[56] References Cited

U.S. PATENT DOCUMENTS 3,530,477 9/1970 Jarrett et al. ..... 343/765

3,821,746 6/1974 Mizusawa et al. ..... 343/839

*Primary Examiner*—Eli Lieberman

*Attorney, Agent, or Firm*—Robert E. Burns; Emmanuel J. Lobato; Bruce L. Adams

[57] ABSTRACT

An antenna apparatus comprising a primary radiator having an axially symmetric field pattern, and a main reflector and a subreflector coupled to the primary radiator through a beam wave-guide path. The antenna rotating axis is aligned with the axis of the primary radiator but a little deviated from the polar axis or the earth. At least one movable beam waveguide reflector or electromagnetic lens is provided in a radio wave path between the primary radiator and the subreflector. The antenna rotating axis is adapted to be rotatable only within a small angular range. The beam wave-guide reflector or electromagnetic lens is moved to thereby deflect the antenna beam.

9 Claims, 9 Drawing Figures

SATELLITE TRACKING CASSEGRAINIAN ANTENNA

FIELD OF THE INVENTION

This invention relates to an antenna for tracking a geostationary communication satellite which moves within a limited angular range.

BRIEF DESCRIPTION OF THE PRIOR ART

A large aperture antenna is used for satellite communications, and the antenna of this kind is generally a fully steerable type, wherever a communication satellite may stay in the whole sky. Various mount systems have been developed for driving such a large aperture antenna, and one of them is a polar mount system. This system has two rotation axis, which are an hour-angle axis parallel to the polar axis of the earth and a declination axis disposed perpendicular thereto. In one example, a support member supported by the hour-angle axis has mounted thereon the declination axis, on which an antenna such as a cassegrain antenna is mounted. Radio waves arriving at the main reflector are focused on a primary radiator such as a corrugated horn and applied to a radio equipment including a receiver and a transmitter mounted on the support member through a rotary joint. In case of transmission, radio waves are radiated in a path opposite to the above. In another example, the radio equipment is provided at the back of the main reflector and rotatable together with the main reflector, so that no rotary joint is required. In these example, there are provided with driving devices for the rotation of the hour-angle axis and the declination axis. In these cases, the direction of the antenna beam can be greatly deflected. However, the radio equipment moves with the rotation of the hour-angle axis in the former example and with the rotation of the hour-angle axis and the declination axis in the latter example. They are usually disposed at the high position above the ground, so that maintenance is inconvenient. In addition, the declination axis is disposed at the high position above the ground and this is a weak point from the view point of the mechanical construction. Further, many of present communications satellites are geostationary ones and, with the improvements of satellite launching skills and attitude control techniques, the moving angular range of the geostationary satellite has become much narrow. To track such a satellite, the fully steerable antenna system introduces bulkiness in the structure and complexity in the driving mechanism and hence is inadvisable from the economical point of view.

On the other hand, the present inventors had previously proposed an antenna capable of scanning its radiation beam in U.S. patent application Ser. No. 533,800, now abandoned, entitled "Aperture Antenna." This is an antenna which is designed so that an antenna beam can be deflected in two directions (for example, in the horizontal direction and the vertical direction), with the main reflector being fixed, by shifting a beam wave-guide reflector disposed in a radio wave path between the primary radiator and the main reflector. In this proposed antenna, the servo-drive mechanism can be simplified, while maintenance and operation become easy by installing the radio equipment on the ground. However, this antenna has such a disadvantage as a little narrow tracking range for the direction of the geostationary arc of the present geostationary satellites.

BRIEF SUMMARY OF THE INVENTION

An object of this invention is to provide an antenna apparatus having a main reflector and a subreflector coupled to a primary radiator through beam wave-guide reflectors and having a relatively wide tracking range for a geostationary communication satellite.

To attain the above object of this invention, an antenna rotating axis is aligned with the axis of the primary radiator but a little deviated from the polar axis and is constructed to be rotatable within a small angular range to cover the movement range of the geostationary communication satellite along the geostationary arc. Further, in this invention, instead of providing the servo-drive subsystem for the declination axis, at least one of a beam wave-guide reflector or an electromagnetic lens, which is installed in a radio wave path between the primary radiator and the subreflector, is constructed to be movable.

BRIEF DESCRIPTION OF THE DRAWINGS

The principle, construction and operation of this invention will be clearly understood from the following detailed description taken in conjunction with the accompanying drawings, in which.

DETAILED DESCRIPTION OF THE INVENTION

Figure 1:
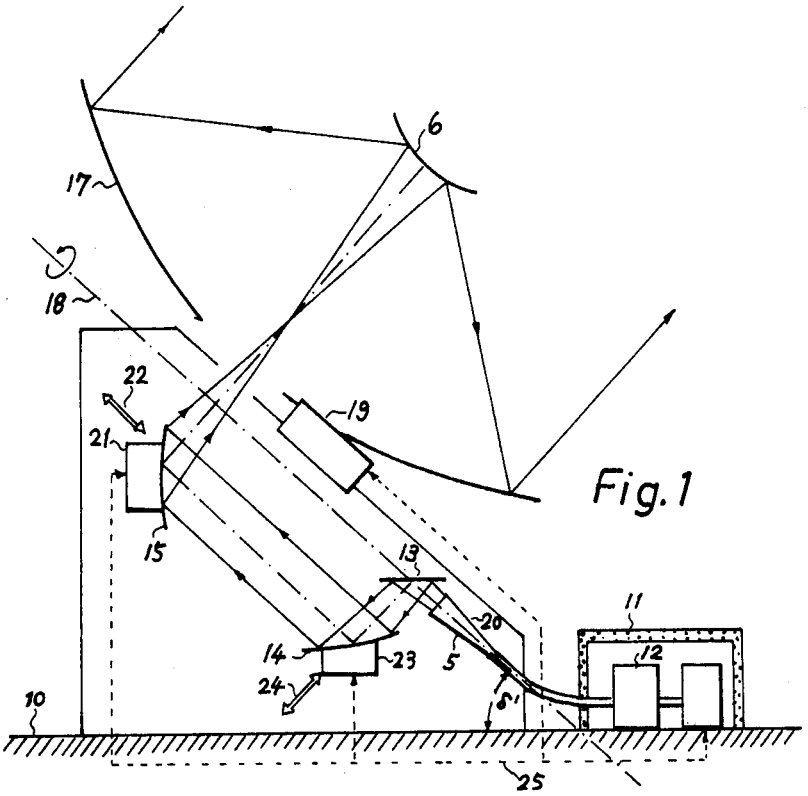
FIG. 1 is a schematic structural diagram illustrating an embodiment of this invention.

This invention can be applied to a receiving antenna and a transmitting antenna. However, for convenience of explanation of this invention, the following description will be given of a transmitting antenna. With reference to FIG. 1, radio waves transmitted from a transmitter 12 installed in a station 11 are applied to the primary radiator 5 having an axially symmetric field pattern and then guided by one plane reflector 13 and two beam wave-guide offset parabolic reflectors 14 and 15, therafter being radiated through a subreflector 16 and a main reflector 17. The main reflector 17, the subreflector 16 and the beam wave-guide reflectors 13, 14 and 15 can be simultaneously rotated as one body about one rotary axis 18 by means of a driving device 19, and an axis 20 of the primary radiator 5 is installed in alignment with the rotary axis 18. Further, unlike the polar axis in the prior art, the rotary axis 18 of the antenna is tilted at an angle $\delta'$ deviated by $\Delta\delta$ from the latitude $\delta_o$ as will be described later on. The beam wave-guide reflector 15 is adapted to be shifted in a direction 22 by a driving device 21 substantially in parallel with the antenna rotary axis 18. By this shift, the feeding point to the subreflector 16 is shifted, so that the beam radiated from the main reflector 17 can be deflected in a direction perpendicular to the direction of movement on the antenna rotary axis 18. Further, if necessary, by shifting the other reflector 14 in a direction substantially perpendicular to the antenna rotary axis 18 in a direction 24 by means of a driving device 23 employed as a second drive means, the antenna characteristic for beam deflection can be improved.

Figure 2:
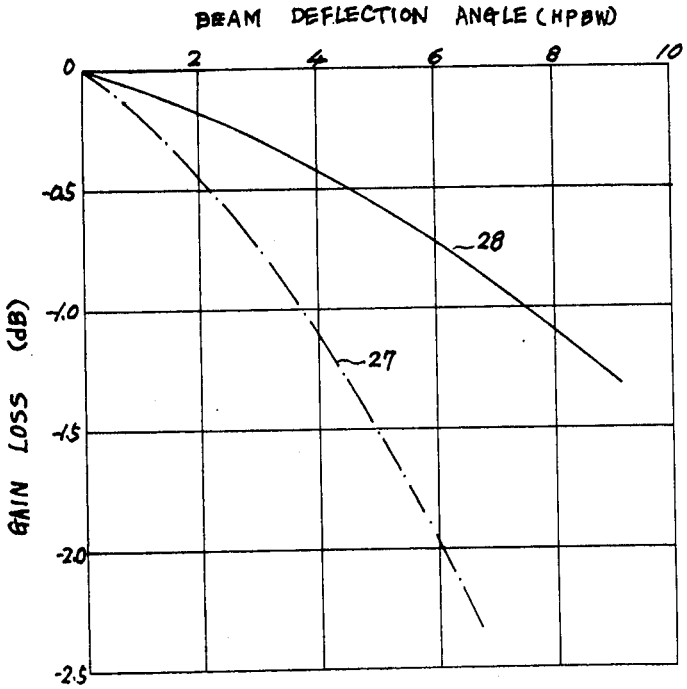
FIG. 2 shows beam deflection characteristics under movement of a beam wave-guide reflector.

FIG. 2 shows the improvement of the beam deflection characteristics in this case. In FIG. 2, there is shown the outline of the relationship of a beam deflection angle (normalized by a 3 dB beam width (HPBW)) versus the antenna gain loss. A curve 27 indicates a case in which only the beam wave-guide reflector 15 is moved substantially in parallel with the antenna rotary axis 18. A curve shows a case in which the beam wave-guide reflector 15 is moved substantially in parallel with the antenna rotary axis 18 and, further, the other beam wave-guide reflector 14 is moved in a direction substantially perpendicular to the rotary axis 18 to compensate for wavefront distortion in the aperture plane of the antenna and spill over. As shown in FIG. 2, if the beam deflection angle is selected a little large, shifting of the reflector 14 in the direction perpendicular to the rotary axis 18 will be highly effective to provide higher antenna performance.

Figure 3A:
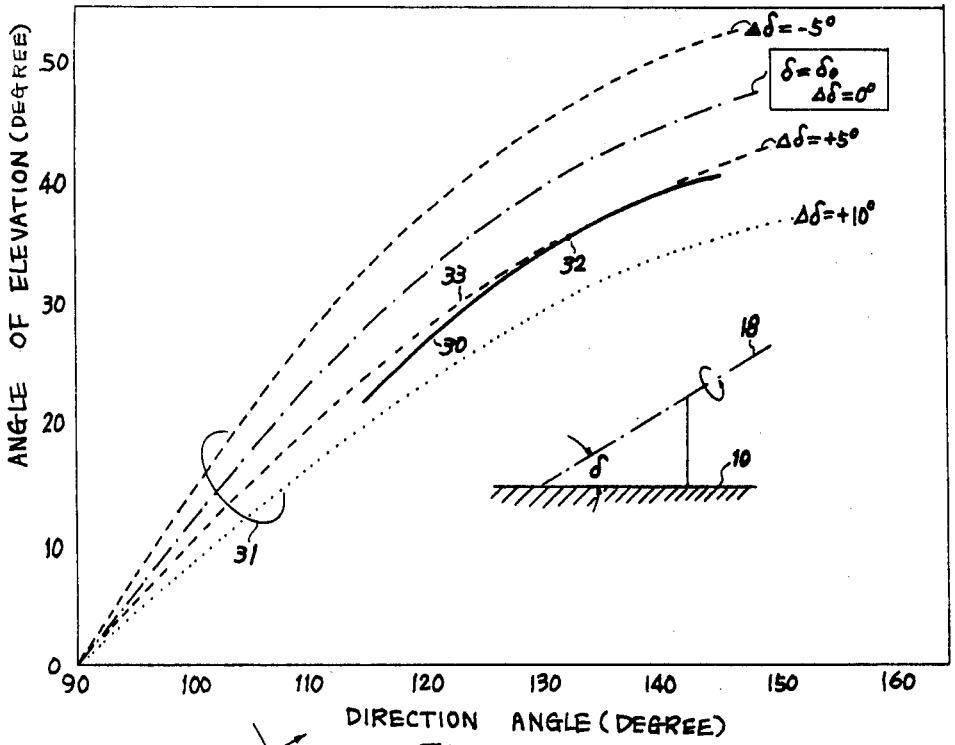
FIG. 3A shows characteristic diagrams showing the relationship between the geostationary arc and the loci of the pointing direction of a polar mount antenna.

Now, a description will be made of the reason for which the antenna rotary axis 18 is tilted at the angle $\delta'$. FIG. 3A shows loci 31 of moving points indicative of the pointing direction of the polar mount antenna and a geostationally arc 30 observed from the earth station located at 36°7'N and 140°7'E. The parameter $\Delta\delta$ is the offset angle of the polar axis in the elevation plane from the ordinary value of $\delta o$, which is equal to the latitude of the earth station. In FIG. 3A, if it is assumed that the satellite stays, for example, in the vicinity of 174°E, its direction is in the vicinity of the point 32, and a locus of the antenna beam passing through the point 32 assumes a curves 33 so that the optimum inclination angle of the rotary axis 18 has a value deviated about 5° from the latitude ($\delta_o$). Namely, an optimum value of the inclination angle $\delta$ of the rotary axis is not aligned with the latitude $\delta_o$ of the earth station but set at another inclination angle $\delta'(\delta'=\delta_o+\Delta\delta)$. If the elevation of the earth station antenna is low, this rotary axis is shifted a little in the azimuth direction with its inclination angle being held at the latitude ($\delta_o$). This axis will be hereinafter refered as the quasi-polar axis.

Figure 3B:
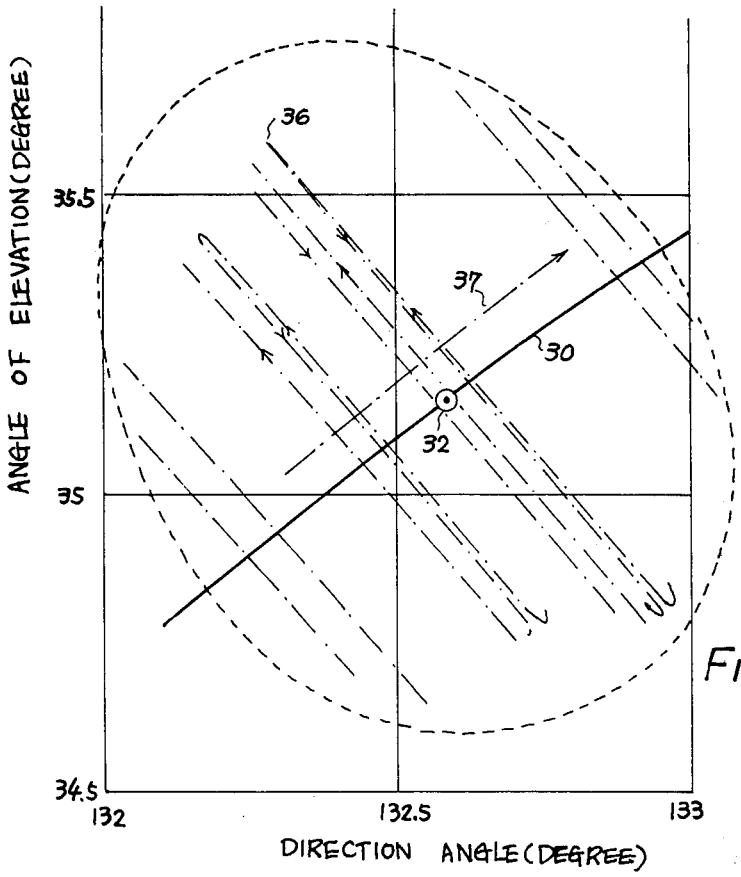
FIG. 3B is a characteristic diagram showing an example of the movement course of a communication satellite.

FIG. 3B shows an example of movement of the satellite observed from the abovesaid earth station. Reference numeral 30 indicates the locus of the satellite shown in FIG. 3A; 36 designates the daily movement of the satellite; and 37 indicates the long-term movement. The long-term movement 37 can be tracked by slight rotation on the quasi-polar axis 18 and the daily movement 36 can be tracked by shifting the small beam wave-guide reflector 15. In the above description, the position of the satellite is shown by one example of the INTELSAT IV satellite staying above the Pacific Ocean but the same is true of other communication satellites staying at other places.

Figure 4:
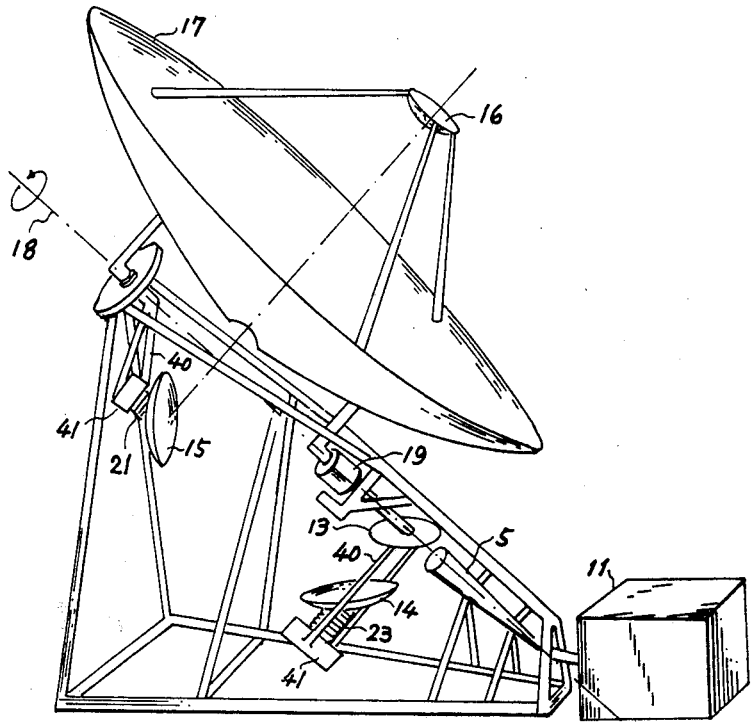
FIG. 4 is a perspective view of the antenna shown in FIG. 1.

FIG. 4 is a bird's-eye view of the antenna shown in FIG. 1. The beam wave-guide offset parabolic reflectors 14 and 15 are respectively mounted on lead screws 23 and 21 provided on bases 41 supported by support frames 40. By the lead screws 23 and 21, the reflectors 14 and 15 can be shifted within limited driving ranges, respectively.

Figure 5A:
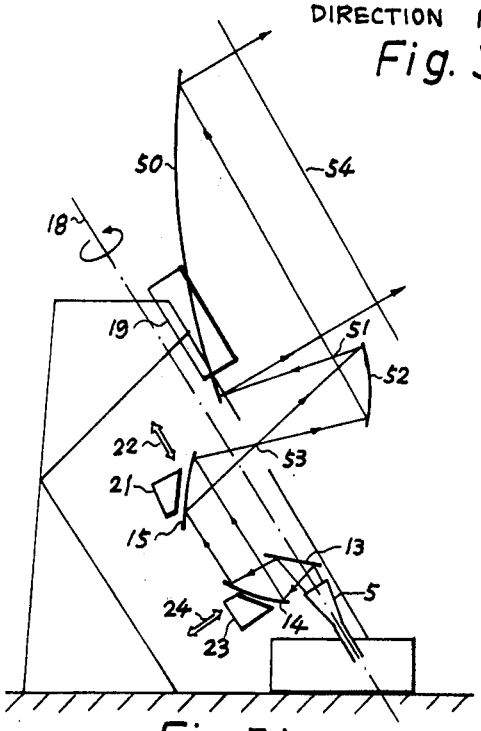
FIGS. 5A, 5B and 7 are schematic structural diagrams each illustrating another embodiment of this invention.

FIG. 5A illustrates an offset type antenna which is another embodiment of this invention. A main reflector 50 an an elliptic subreflector 52 have a common focus 51 and the beam wave-guide offset parabolic reflector 15 focused on the other focus 53 of the elliptic reflector 52. The primary radiator 5, the elliptic reflector 52 and the main reflector 50 are disposed so that radio waves emitted from the primary radiator 5 and having an electric field distribution having the symmetry of rotation may be guided via the reflectors 13, 14, 15 and 52 to have the symmetry of rotation in the aperture plane 54 of the main reflector 50. Also in FIG. 5A, the plane reflector 13, the two beam wave-guide reflectors 14 and 15 and the elliptic subreflector 52 can be limitedly rotated as one body around the quasi-polar axis 18. The beam wave-guide reflector 15 is movable in the direction 22 substantially parallel to the quasi-polar axis 18 in addition to the abovesaid rotation. Further, another reflector 14 is moved to compensate for the wavefront as is the case of FIG. 1.

Figure 5B:
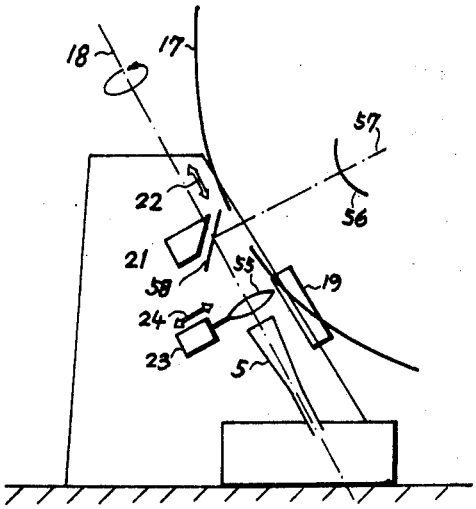

FIG. 5B shows another example of this invention which employs an electro-magnetic lens 55 for the beam wave-guide. In this antenna, the main reflector 17 is a parabolic one and a subreflector 56 is also a parabolic one having a common focus 57. In FIG. 5B, radio waves emitted from the primary radiator 5 are converted by the lens 55 into parallel beams, which are applied to a planar reflector 58. By shifting the planar reflector 58 in the direction of the antenna rotary axis 18, the beam direction radiated from the main reflector 17 is deflected. In order to compensate for the wavefront shape and spill over loss from the main reflector 17, the lens 55 is shifted in the direction 24 perpendicular to the rotary shaft 18.

Reference numeral 19 in FIGS. 5A and 5B indicates driving devices for rotating the antenna system around the quasi-polar axis 18 only within a small angular range; and 21 and 23 designate also the driving devices for the beam deflection and wavefront compensation, respectively.

Figure 6:
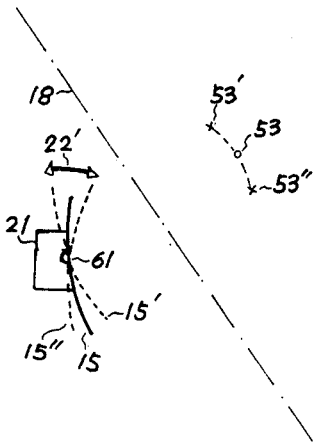
FIG. 6 is a diagram illustrating a beam wave-guide reflector controlled by another moving principle.

In the foregoing, the beam wave-guide reflector 15 or the plane reflector 58 is moved in the direction parallel to the antenna rotary axis 18 for deflecting the beam direction, as shown in FIG. 6, however, substantially the same results can be obtained by rotating the reflector 15 (or the plane reflector 58) on a fulcrum 61 in a direction 22' of the arrow to the position 15' or 15'' to change the position of the feeding point 53' or 53''.

Figure 7:
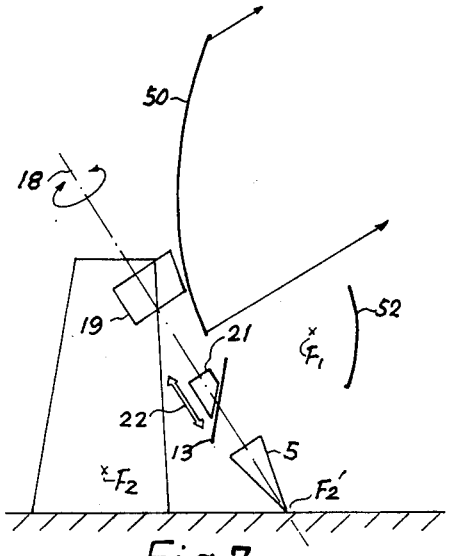

FIG. 7 illustrates another embodiment which employs one movable beam wave-guide reflector. The main reflector 50 is an offset parabolic one and the subreflector 52 is an elliptic reflector using a common focus $F_1$. The phase center of the primary radiator 5 is held in agreement with an image $F_2$ by the plane reflector 13 using the other focus $F_2$ of the elliptic reflector 52. Further, the axis of the primary radiator 5 is aligned with the antenna rotary axis 18. The main reflector 50 and the subreflector 52 can be rotated as one body about the antenna rotary axis (the quasi-polar axis) 18 by the driving device 19. Moreover, the rotation about the declination axis can be achieved by moving the plane reflector 13 by the driving device 21 in the direction of the arrow 22.

As has been described in the foregoing, in case of directing a beam of a large aperture antenna to a geostationary satellite moving within a certain limited range, the limited steerable type antenna of this invention is highly effective, which is adapted to perform limited rotation about the quasi-polar axis within a small angular range with respect to the orbital direction of the satellite and to shift the beam wave-guide reflector with respect to the direction perpendicular to the orbital direction of the satellite. Further, since the antenna beam can be deflected without remarked degradation of the antenna performance and since small-sized reflectors are shifted for the beam deflection, the driving device may also be small. Moreover, the radio equipment can be installed on the ground and this is convenient for working and maintenance of the antenna apparatus.

What we claim is:

1. An antenna apparatus comprising:

a primary radiator having an auxiliary symmetric field pattern;

a subreflector coupled to said primary radiator through a beam wave-guide path;

a main reflector coupled to said subreflector through a beam wave-guide path;

movable wave-guide means provided in said beam wave-guide path between said primary radiator and said subreflector;

rotation means coupled to said primary radiator, said subreflector, said main reflector and said movable beam wave-guide means for rotating, within a small angular range, said primary radiator, said subreflector, said main reflector and said movable beam wave-guide means as one body about an antenna rotating axis aligned with the axis of the primary radiator but a little deviated from the polar axis of the earth; and drive means coupled to said movable beam wave-guide means for controlling said movable beam wave-guide means to deflect an antenna beam radiated from said main reflector.

2. An antenna apparatus according to claim 1, in which said movable beam wave-guide means comprises at least one movable reflector.

3. An antenna apparatus according to claim 1, in which said movable beam wave-guide means comprises at least one movable electromagnetic lens.

4. An antenna apparatus according to claim 2, in which said movable reflector is shifted by said drive means in parallel to said antenna rotating axis.

5. An antenna apparatus according to claim 2, further comprising a second movable reflector provided in said beam wave-guide path between said primary radiator and said subreflector, and second drive means coupled to said second movable reflector for shifting said second movable reflector in a direction perpendicular to said antenna rotating áxis.

6. An antenna apparatus according to claim 1, in which said drive means comprises a lead screw coupled to said movable beam wave-guide means.

7. An antenna apparatus according to claim 5, in which said second drive means comprises a lead screw coupled to said second movable reflector.

8. An antenna apparatus according to claim 1, in which said primary radiator, said subreflector and said main reflector are so installed that said antenna beam is axially symmetric on the aperture plane of said main reflector.

9. An antenna apparatus according to claim 2, in which said movable reflector is provided by said drive means.

* * * * *